US008387903B2

(12) United States Patent
Lunde et al.

(10) Patent No.: US 8,387,903 B2
(45) Date of Patent: Mar. 5, 2013

(54) APPARATUS AND A METHOD FOR DESTRUCTURING OF ARTICLES

(75) Inventors: Tom Lunde, Blommenholm (NO); Roar Abrahamsen, Sarpsborg (NO)

(73) Assignee: Tomra Systems ASA, Asker (NO)

( * ) Notice: Subject to any disclaimer, the term of this patent is extended or adjusted under 35 U.S.C. 154(b) by 258 days.

(21) Appl. No.: 12/739,892

(22) PCT Filed: Nov. 6, 2008

(86) PCT No.: PCT/NO2008/000389

§ 371 (c)(1),
(2), (4) Date: Jul. 28, 2010

(87) PCT Pub. No.: WO2009/061206

PCT Pub. Date: May 14, 2009

(65) Prior Publication Data

US 2011/0017851 A1 Jan. 27, 2011

(30) Foreign Application Priority Data

Nov. 7, 2007 (NO) ..... 20075686

(51) Int. Cl.
*B02C 18/22* (2006.01)

(52) U.S. Cl. ..... 241/30; 241/99; 241/135; 241/236

(58) Field of Classification Search ..... 241/236, 241/30, 99, 135; 100/94, 98 R, 902
See application file for complete search history.

(56) References Cited

U.S. PATENT DOCUMENTS

| | | | | |
|---|---|---|---|---|
| 4,323,009 | A * | 4/1982 | Voigt | 100/240 |
| 4,398,456 | A * | 8/1983 | Prater | 100/98 R |
| 5,871,162 | A | 2/1999 | Rajewski | |
| 2006/0163397 | A1 | 7/2006 | Baker et al. | |

FOREIGN PATENT DOCUMENTS

| | | | |
|---|---|---|---|
| DE | 202 10 164 | U1 | 12/2002 |
| DE | 20210164 | U1 | 12/2002 |
| WO | 03051620 | A1 | 6/2003 |
| WO | 2006114222 | A1 | 11/2006 |

* cited by examiner

*Primary Examiner* — Mark Rosenbaum
(74) *Attorney, Agent, or Firm* — Rodman & Rodman

(57) ABSTRACT

An apparatus and a method for receiving and destructuring collectable items, the apparatus having at least one item destructurer (112,113) at an exit of the apparatus. The apparatus comprises an item receiving floor (114); an item pusher (115) reciprocally slidable along the floor, means for causing an item when placed on the floor to be engaged by one or the other side of the pusher and pushed towards and into engagement with said destructurer, and pusher drive means (117) configured to provide gradually increasing pushing force on the item towards the destructurer. Means may be provided for selectively causing an item when placed on the floor either to exit through the floor via a trap door device or to be engaged by one or the other side of the pusher and pushed towards and into engagement with said destructurer.

11 Claims, 4 Drawing Sheets

APPARATUS AND A METHOD FOR DESTRUCTURING OF ARTICLES

The present invention relates to an apparatus and a method for receiving and destructuring collectable items, as defined in the preamble of claim 1; and a method for receiving and destructuring collectable items, as defined in the preamble of claims 10.

It is known in the prior art that collecting and handling of collectable items, such as e.g. empty beverage containers, requires that a reverse vending machine (RVM) is used or that at least equipment that can be made operative in a system for handling such items is to provided. Such RVM's more than often require a "back room" facility for receiving the items, which may take up much space in a retailer shop or a supermarket. Therefore, some systems have been made where the collected items have been crushed (e.g. glass bottles), or flattened (e.g. plastic bottles or cans), and where the destructured items have exited into collection boxes in a lower part of the RVM.

In a recent RVM structure, as disclosed in PCT/NO2006/000029, the items are after identification delivered in a non-destructured state into at least one vertical storage chamber to move in an upward direction therein. The RVM is compact and is suitable at locations where the RVM may have a height in the range of e.g. 200-250 cm. However, at other locations, the height dimension may be problematic, in addition to the available space in depth and length being crucial parameters. Further, in most cases such RVM's are designed to operate indoors or at least in a sheltered environment to protect sensitive electronics and above all optics from operational failure, e.g. due to moist, dust and changes in temperature.

Further, although some RVM's have receptacles for collecting returnable items, it is inconvenient that such receptacles are to be frequently removed and emptied into other larger collection containers, and the emptied receptacle be brought back to the RVM for further collection of returnable items. Compacting, shredding, flattening, chipping, flaking and/or granulating, or in general terms destructuring of such collected items may be a pre-requisite for installing an RVM in a confined space.

Another challenge in RVM's is related to generation and viewing of an image of a returnable item against a specular or retro-reflective surface, due to inherent problems caused by deposition of dust and polluting particles on parts which form an optical unit. Such deposition is often caused by heat generating components which cause a so-called chimney-effect.

The invention has therefore as an object to provide apparatus which in provides an RVM having outstanding properties with regard to compact physical structure, i.e. reduced cabinet size, operational stability, protected detection equipment, efficient destructuring of collected items, easy maintenance of and access to operational parts, and convenient disposal of collected, destructured items, in addition to the RVM being easy to operate by a customer. Notably, the requirements for lower cost of transportation per collected item and larger storage capacity at the place of collection dictate the need for destructuring of the returnable items.

Although the invention is in particular useful in reverse vending machines (RVM), it will be readily understood by the average expert in the art that the apparatus as disclosed may be used separately in other RVM's or related equipment suited for collecting and handling returnable items.

The apparatus of the invention is of a type suitably having at least one item destructurer at an exit of the apparatus. The apparatus has an item receiving floor, an item pusher reciprocally slidable along the floor, and means for causing an item when placed on the floor to be engaged by a surface of the pusher and pushed towards and into engagement with said destructurer. The drive means of said item pusher is configured to provide gradually increasing pushing force on the item along the floor towards the destructurer, and the pusher drive means comprises a drive motor and a pushing force mechanism.

The method of the invention comprises to cause an item when placed on an item receiving floor to be engaged by a surface of a pusher which is reciprocally movable along the floor, and pushing the item by means of the pusher towards and into engagement with a destructurer at an end region of the floor to destructure the item by means of the destructurer. More specifically, the pushing is performed by using gradually increasing pushing force on the item towards the destructurer. Alternatively to the pushing, the method provides for an item when placed on the item receiving floor to exit through a trap door device in the floor and then passing the item to a destructurer subsequent to the item exiting through the floor.

The characteristic features of the apparatus for receiving and de-structuring collectable items are defined in claim 1. Further embodiments of the apparatus are defined in the dependent claims 2-9.

The characteristic features of the method for receiving and de-structuring collectable items are defined in claims 10. Further embodiments of the methods are defined in the respective dependent claims 11 and 12.

The invention is now to be further explained with reference to the attached drawings which exhibit typical embodiments of the invention, although these are not to be construed as in any way limiting the scope of the invention, but are included merely to appreciate the concepts of the invention.

The present invention, as claimed, is concerned with aspects of sorting and destructuring of collectable items, and an apparatus and a method related thereto.

However, the present disclosure also describes an apparatus for viewing and detecting images of an item at least partly against a reflective surface, and some considerations related to avoidance of inherent problems of relative positioning of light source and image detector, in particular from point of view of installation and maintenance. If the light source and image detector are located on separate supports, then complex and time-consuming adjustments may be required for proper operation. Also, it is an important that both the light source and the image detector are mechanically linked in order that e.g. vibration will not be of importance, contrary to instability imposed if e.g. the detector is subjected to vibration and not the light source. Such an apparatus for viewing and detecting images of an item will suitably have an optical system which is efficiently operative with a light source and an image detector, but which is less subjected to contamination caused by dust and pollution in the air, and in particular such contamination caused by so-called "chimney-effect". The apparatus for viewing and detecting has been located upstream of and proved to be useful with the apparatus for sorting and destructuring collectable items, and a description thereof is therefore given below.

Figure 1:
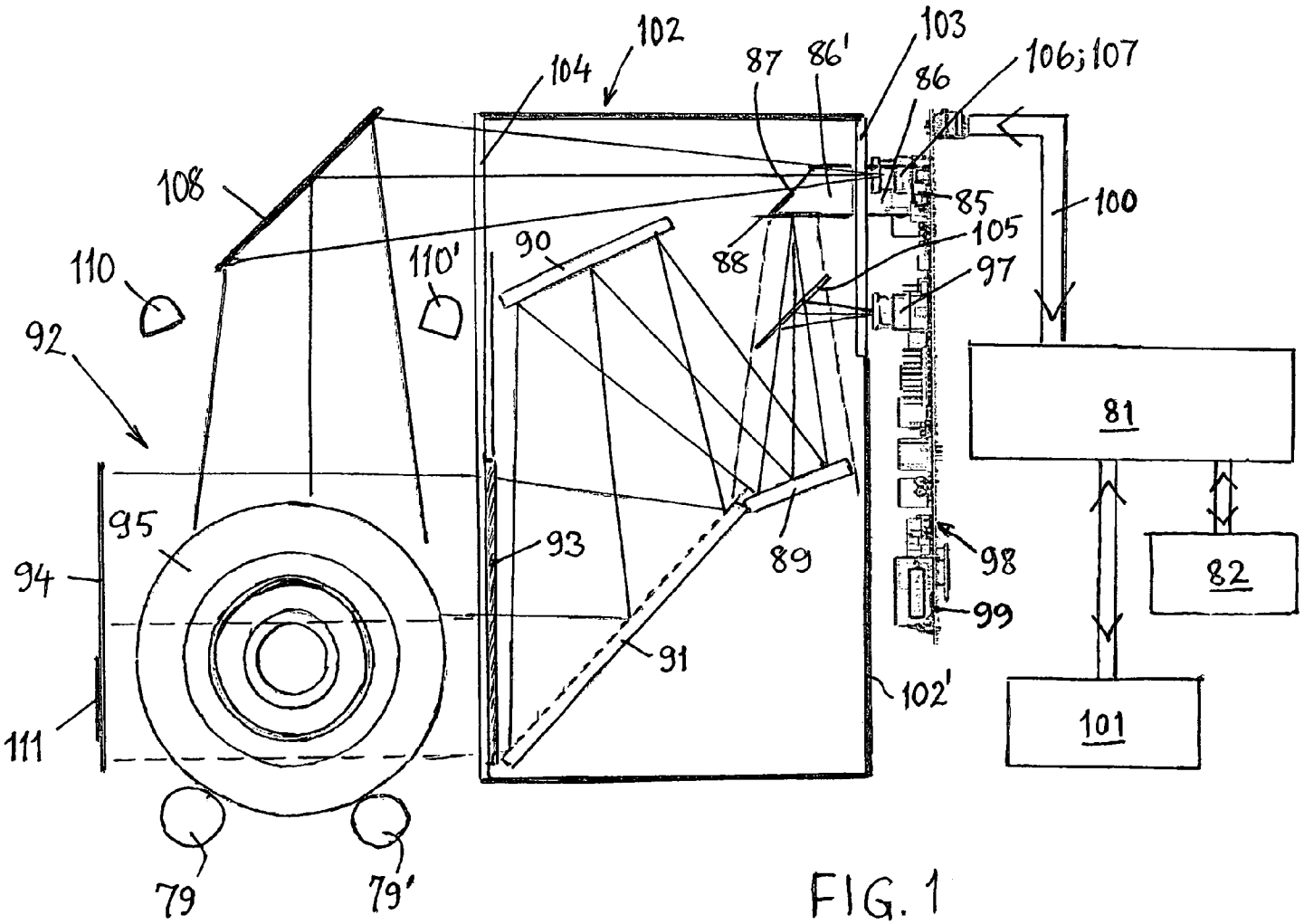
FIGS. 1-3 illustrate an apparatus, which does not form a part of the invention as defined in the claims, for detecting images and other features of a collectable item and useful for operating with an apparatus for sorting and destructuring of collectable items.
Figure 4:
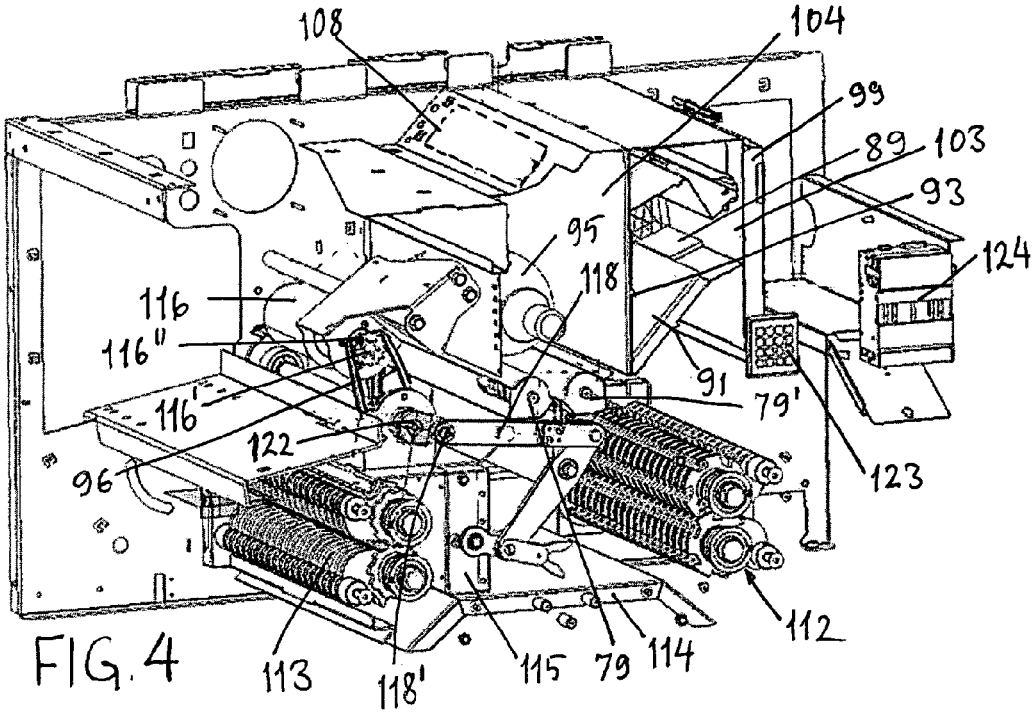
FIGS. 4 and 5 illustrate aspects of the apparatus, according to the invention, for sorting and destructuring collectable items, and with said detection apparatus also being shown.
Figure 5:
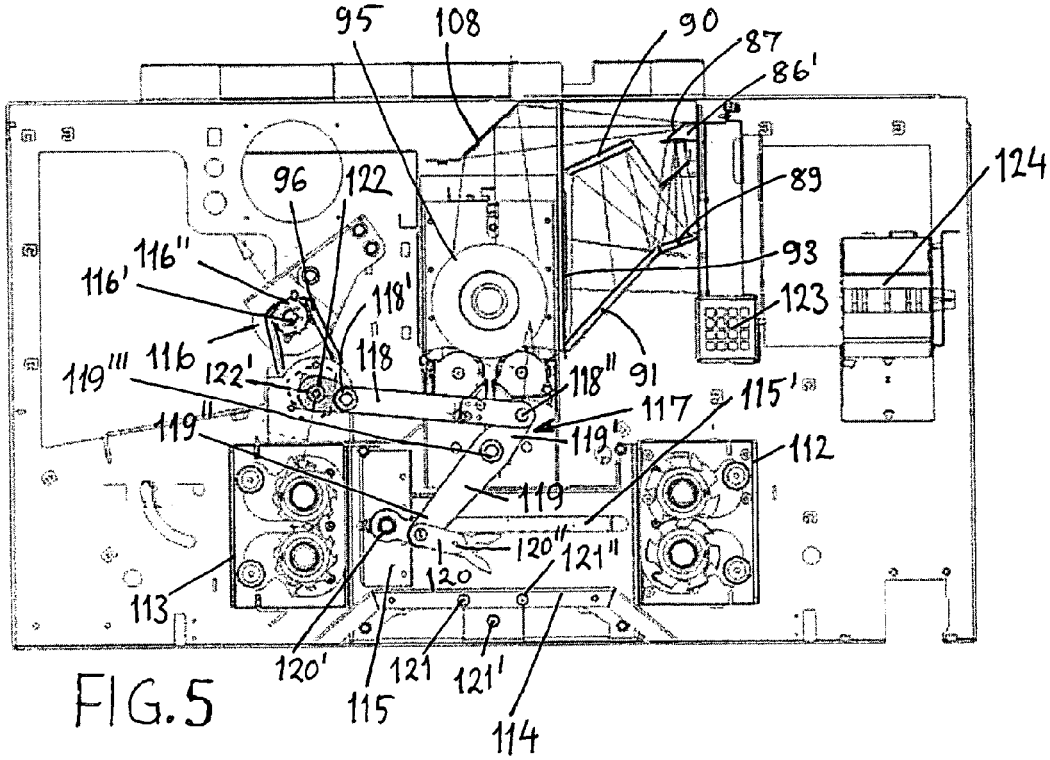

As shown on FIG. 1, in order to overcome the challenges related to the apparatus for viewing and detecting an item, there is provided a light source 85 capable of projecting light into a tubular light guide 86, 86', the walls of which on the inside of the guide being light reflective, towards a 45° inclined mirror 87, and to project light therefrom through a light diffuser 88 via a light path extender provided by mirrors 89, 90 and 91 towards a detection space via a lens 92 and towards a light reflective surface 94 along the opposite side of the space 92. The reflective surface 94 is a specular mirror or a retro-reflective panel. The space 92 is configured and dimensioned so as to accommodate an item 95. The item 95, e.g. a transparent, partly transparent or non-transparent bottle, or a can of metal, is suitably temporarily placed on a pair of rotary rollers 79, 79' in order to, if required, to rotate the item to find features thereof or is thereon not properly detectable in an initial rotary position of the item 95. The rollers 79, 79' are movable apart from each other subsequent to detection of the item, the item thereby falling between the rollers and down to further handling apparatus, as will be apparent in particular from viewing FIGS. 4 and 5.

Figure 3:
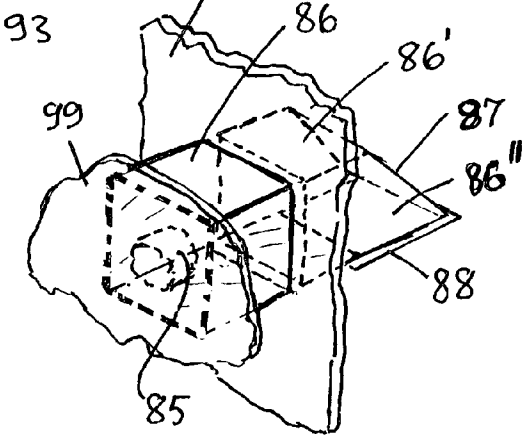

The inventive light guide 86, 86' is, as indicated on FIG. 3 formed by two parts, the first part 86 extending from the light source 85 to a window element 103 of an optical compartment 102, to be further explained below, and a second part 86' terminated by the inclined mirror 87 where light exits through an aperture 86" and then through the light diffuser 86.

A camera 97 is configured to detect any light reflected from said surface 94 and not hidden by the item 95, thus representing an image of the item 95. Operational electronics 98 are associated with said light source 85 and said image detecting camera 97. Said light source 85, said camera 97 and said operational electronics 98 are all installed on a single, common circuit board 99, and said light source 85 and said camera 97 are laterally spaced from each other on the common circuit board 99, as clearly seen on FIG. 2.

A major advantage, though, is that the source 85 and the camera 97 are on a single, common circuit board, thus having a strong mechanical link. Further, such structure enables convenient installation with neglible or a minimum of adjustments, compared to alignments and adjustments required if the devices had been located on separate circuit boards. Also, if a failure of any of the devices 85 and 97 happens, or for that matter the electronics 98, the entire circuit board 99 can simply be unplugged and replaced by a new unit.

The electronics 98 are suitably connected via a cable 100 to a processor, such as the previously mentioned processor 81, the processor capable of delivering at its output also data related to an image or images of the item 95. The processor 81 is suitably connected to an image library 101 in order to swiftly compare detected characteristics with image characteristics present in the library.

A concern from point of view of maintenance is to keep the optical part of the detection system clean. Such cleanliness can be a substantial challenge, e.g. when the apparatus is intended for operating in a polluted atmosphere, such as may be present in major cities. In most cases the heat generating electronics and lighting are located at a top region of an optical system, such as including mirrors and lenses. Although such optical system may be substantially enclosed, nevertheless the positioning of such heat generating components easily creates the mentioned, so-called chimney effect, which implies that dust and other potentially polluting particles are drawn through the optical system and thereby easily accumulate on optical parts therein.

In order to reduce such contamination and thereby reduce any cleaning to a minimum, the circuit board 99 is located exterior to an upright face 102' of the closed optics compartment 102. Closed in this context may imply enclosed component assembly, the assembly possibly sealed, pressure compensated, substantially enclosed or at least substantially dustproof. The part of the compartment 102 being adjacent said circuit board 99 is closed by the transparent window element 103, and the part adjacent said space 92 is closed by the lens 93. The lens may suitably be a Fresnel lens, although other lens types could be used. Because such a lens element is vulnerable to scratches, a protective light transparent panel 104 is located between the lens 93 and said space 92. The panel is suitably fitted to a housing or frame of the compartment 102 in a sealed manner to avoid any dust or pollution between the lens 93 and the panel 104.

As mentioned above, the light source 85 and the camera 97 are facing said window element 103 to allow light rays from the source 85 to pass through the guide part 86, through the window element 103, through guide part 86', and then via the inclined mirror 87, the diffuser 88, and then further via the light path in said closed optics compartment 103 and said lens 93 and panel 104, and through which window element 103 the camera 97 is able to receive an image of the item 95 as a function of light reflected from the reflective surface 94 and passed via the panel 104, said lens 93, the closed optics compartment 102, and via a 45° inclined, second mirror 105 and the window element 103 through to the camera 97.

The purpose of the lens is to provide parallel light rays across the space 92 towards the reflective surface 94. Therefore, the lens 93 is located adjacent said space 92, and will cause light rays reflected from said reflective surface 94 to be focused towards the camera via the light path extender composed of the mutually inclined mirrors 91, 90 and 89 and said second light redirecting mirror 105 in said closed optics compartment. The term "light path extender" in the present context is in the art of optics frequently also denoted as "folding mirror" device. It simply means that the light path is folded by means of mirrors to extend the total path length the light must travel from an input end to an output end. Although any suitable lens or light ray refractor could be used, the is present invention provides a Fresnel lens as the preferred embodiment of the lens element 93.

It will be appreciated from viewing FIG. 1 that the focus of the lens 93 will be beyond the to the right hand side of the drawing sheet. As it is important to make the overall apparatus as compact as possible, the use of the light path extender is essential.

An essential aspect in this context is also to make certain that light from the source 85 is not scattered before reaching the compartment 102 and also that the light when having entered the compartment is properly directed in order to present therein a small, though powerful light source. Therefore, the light guide 86 which surrounds the light source 85 extends from the circuit board 99 to the face of the window element 103. If the guide 86 had not been present, the window element would have scattered a substantial part of the light from the light source 85 back towards to circuit board, in addition to have passed stray light into the compartment. Therefore, the use of the light guide part 86' on the other side of the window element is also essential to provide a concentrated light beam towards the inclined mirror 87.

In order to enable the optical system to become as compact as possible, it is necessary to provide the light path extender 89-91, in the chosen example comprised by three mirrors 89-91 which are inclined relative to each other and relative to the horizontal. The extender is, as seen on FIGS. 1 and 2, in a light path between the mirror 87 and its downstream diffuser 88, and the lens 93. The use of light path extenders is, as mentioned, commonly known within the art of optics.

The use of the light diffuser 88 located downstream of at the first light redirecting mirror 87 will form a light source with small or limited extension, however larger than a point light source. In view of the fact that the focal point of the lens will change slightly as a function of environmental temperature changes which might affect the lens material, the light source as provided as seen when viewing the diffuser 88 will thereby enable to compensate for such deviations.

The size of the light source, in this case the light as appearing from the diffuser, will cause the optical system to be more robust to temperature variations the larger it is, but if the size becomes too large, the light source will become less efficient. The issue therefore becomes a trade-off between tolerance to temperature deviations and light source efficiency.

In view of the camera 97 not being at the same location on the circuit board as the light 85, it is essential to enable a reflected image to be directed towards the camera. Therefore, the second 45° positioned light redirecting mirror device 105 is semi-transparent to operate as a beam splitter and is located in the light path between said diffuser 88 and a first part 89 of the light path extender 89-91. The use of a beam splitter is inter alia known from GB patent 2,288,016.

It will be appreciated that the use of a lens 93 is preferable from the point of view of directing the light across the space 92 as parallel light rays. However, if a lens were not to be used, this would imply that the item would be viewed in a perspective view. This would in a way be acceptable, provided that the position of the item would always be exact in the space, as size errors and other errors otherwise could easily appear. Further, the processing of detected images would be more complex, and the type of reflective surface 94 would have to be limited to a retro-reflective surface.

Figure 2:
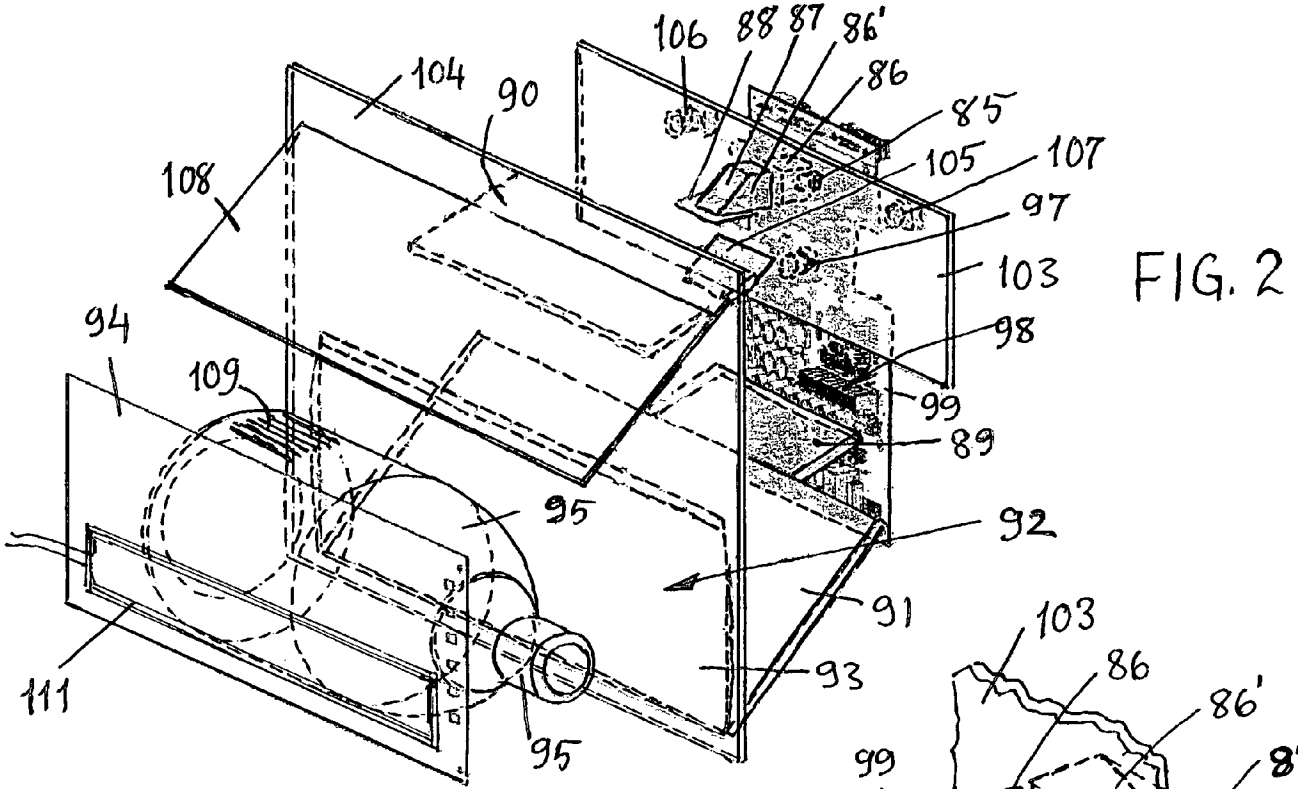

In order to be able to detect features of the item not related to e.g. a contour image detectable by the camera 97, additional cameras 106, 107 may be provided, as seen more clearly on FIG. 2. Such cameras will be able to view the item 95 from above via a 45° inclined, third mirror 108, as seen on FIGS. 1 and 2. These cameras could e.g. view the item 95 in order to detect a bar code 109 or other features present on the item 95. Illumination of the item is suitably made by a pair of light sources 110, 110' or additional light sources. These light sources are, for sake of clarity, not shown on FIG. 2. If the mirror 108 is made semi-transparent, one or more light sources could be located above the mirror 108.

Further, to be able to detect presence of metal in or on the item 95, or to detect whether the item is made from metal, such as in the case of a can, a metal detector 111 may be configured to extend along a substantial length of the rear side of the reflective surface 94.

The apparatus as so far disclosed is fully operable for handling items which are not destructured as well as for handling items which are to be destructured, i.e. in any case after proper material and/or shape or indicia detection.

However, in order to obtain an optimum storage capacity related to number of received and detected items, the present invention provides for an apparatus and a method for receiving and de-structuring collectable items, the apparatus having at least one item destructor 112; 113 at an exit of the apparatus. The apparatus is shown in more detail on FIGS. 4 and 5. The apparatus has an item receiving floor 114 and an item pusher 115 reciprocally and slidably movable along the floor 114. There is provided means, suitably the processor 81 and its output 83 for moving a drive motor 116 to correspondingly drive the pusher 115 to be positioned at correct location on the floor 114, so that the pusher 115 can move the item 95 towards a designated exit and thereby into a related destructuring device, e.g. destructuring device 112 or 113.

Thus, when an item 95 is placed on the floor 114, it will selectively, as a function of the image detection by the camera 97 and any detection by the cameras 106, 107 in cooperation with the processor 81, be engaged by one or the other side surface of the pusher 115 and pushed towards and into engagement with said destructurer 112 or 113. The apparatus is provided with a pusher drive means 117 which is mechanically configured so as to provide gradually increasing pushing force on the item 95 as it approaches the destructurer 112; 113.

The pusher drive means 117 comprises said drive motor 116, first 118, second 119 and third 120 link member pairs, and link registering means 121, 121', 121". Each of said first link members 118 are at one end 118' thereof pivotally operative with a drive shaft 122 powered from a drive shaft 116' of the motor 116 via gears 116" and 122' and a drive chain 96, and at the other end 118" pivotally connected to one end 119' of an associated one of the second link members 119. Each of said second link members 119 is at the other end 119" thereof pivotally linked to an associated one 120 of the third link members at a location between the ends 120', 120" thereof, and at a location 119'" between its ends 119', 119" being pivotally attached to a part of the housing of the apparatus. Each of said third link members 120 is at one end 120' pivotally attached to the pusher 115, and at its other end 120" being fork shaped for successive engagement with registering pins 121, 121', 121" forming said link registering means upon movement of the pusher 115 from one end position to another end position along the floor 114. Interaction between the fork shaped end 120" and the pins 121-121" enables a controlled, reciprocal movement of the pusher 115 when the motor shaft 122 rotates.

As mentioned earlier, the rotary rollers 79, 79' are movable apart from each other once a proper detection of the item 95 has been made, thereby dropping the item onto the is floor 114. Although not shown on FIGS. 4 and 5, the floor 114 could be provided with a trap door mechanism to enable the item to drop right through the floor to a receptacle or other handling equipment below the floor, without the item necessarily being de-structured.

The destructurer is configured to destructure any collectable item in the form of an empty beverage container, in particular a container being made of plastic material or metal, e.g. aluminium. Suitably, the destructurer 112, 113 is elected from the group of: item flattener, item shredder, item chipper, item flaker, and item granulator On FIGS. 4 and 5 there is also indicated a reference 123 which is suitably a control panel, e.g. a keypad, and 124 denotes a printer for providing a token for the returned items.

Figure 6:
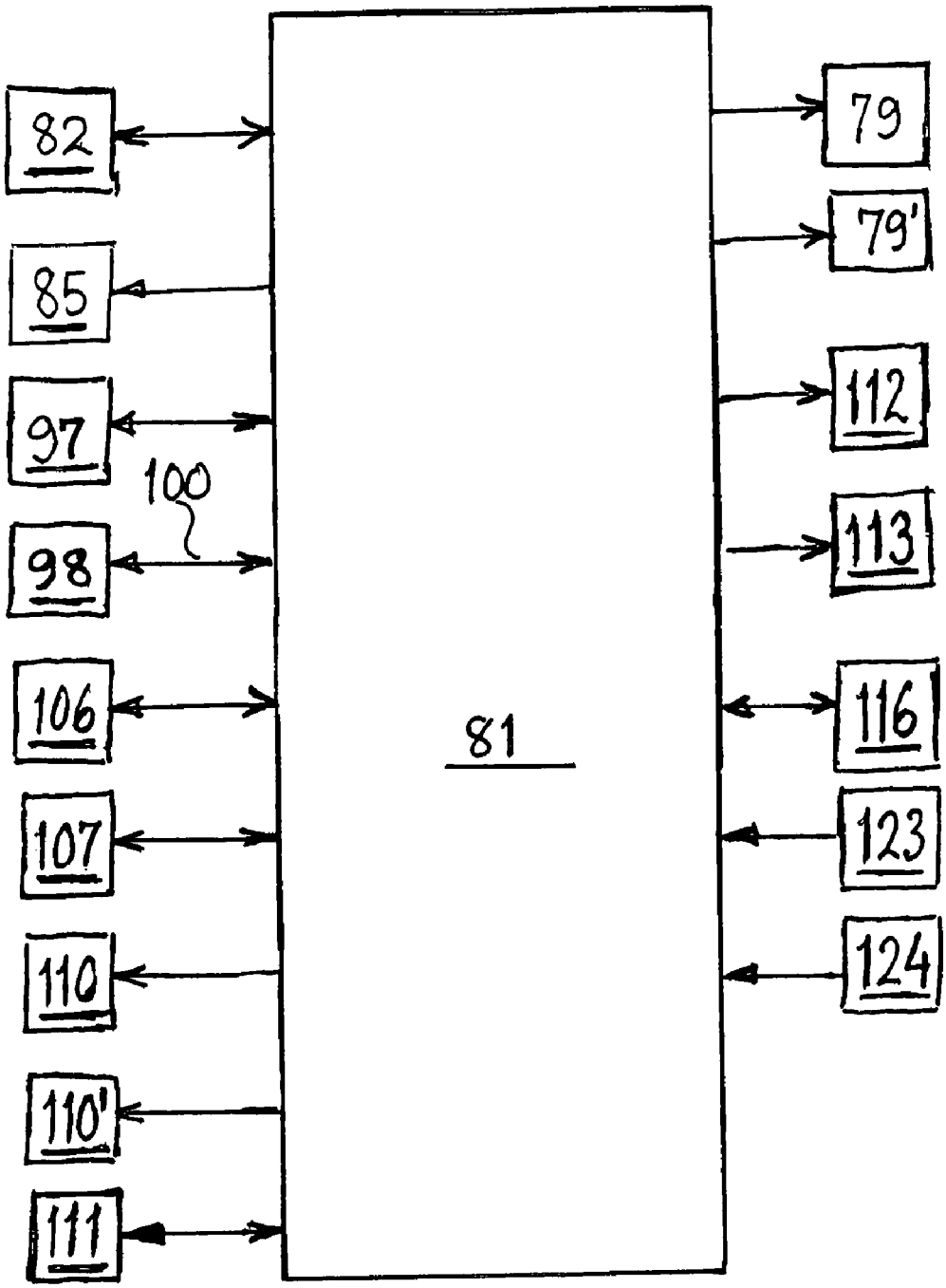
FIG. 6 is schematic overview of electric and electronic components and units which form part of the apparatus of the present invention.

FIG. 6 provides an overview of the electrical and electronic components and units to be controlled by the processor 81 or at least being cooperative with the processor 81. It will be appreciated that the destructurers suitable are powered by motors running on a continuous basis, or at least operating from a point of time an item is entered for detection and until a final item has been entered and finally processed. It is also appreciated that within the processor there are circuits, connections and interfaces to provide for links between units requiring high power and low power, as well as any logic circuits. Although not shown, it will be understood that the processor and its related cooperative units are connectable to an external power supply.

The apparatus as defined is effective to be able to operate as an item sorter, in addition to cause destructuring of the collected item. Although the apparatus is in particular suitable as part of the inventive apparatuses already disclosed, the apparatus is equally suitable for use as a sorting mechanism in which de-structuring is required. Thus, the apparatus is suitable for use in a reverse vending machine, although it is not limited to use in or with a reverse vending machine.

The invention claimed is:

1. An apparatus for receiving and destructuring collectable items, the apparatus having at least one item destructurer at an exit of the apparatus, the apparatus comprising:

an item receiving floor, an item pusher reciprocally slidable along the floor, and means for causing an item when placed on the floor to be engaged by a surface of the pusher and pushed towards and into engagement with said destructurer, wherein drive means of said item pusher is mechanically configured to provide gradually increasing pushing force on the item along the floor towards the destructurer, and wherein said pusher drive means comprises a drive motor and a pushing force mechanism, the pushing force mechanism including at least one pivotally arranged link member and wherein said pushing force mechanism comprises:

first, second and third link member pairs; and link registering means, each of said first link members at one end thereof being pivotally operative with a drive shaft of the motor, and at the other end being pivotally connected to one end of an associated one of the second link members, each of said second link members at the other end thereof being pivotally linked to and associated with one of the third link members at a location between the ends thereof, and at a location between its ends being pivotally attached to a housing of the apparatus, and each of said third link members at one end pivotally attached to the pusher, and at its other end being fork shaped for successive engagement with registering pins forming said link registering means upon movement of the pusher from one end position to another end position along the floor.

2. An apparatus according to claim 1, wherein the apparatus further comprises:

means for selectively causing an item when placed on the floor either to exit through the floor via a trap door device as an alternative to be engaged by the pusher and pushed towards and into engagement with said destructurer.

3. The apparatus of claim 2, wherein an item destructurer is located below said trap door device.

4. The apparatus of claim 1, wherein the destructurer is configured to destructure any collectable item in the form of an empty beverage container.

5. The apparatus of claim 1, wherein the apparatus forms part of a reverse vending machine.

6. The apparatus of claim 1, wherein said destructurer is selected from the group of: item compactor, item flattener, item shredder, item chipper, item flaker, and item granulator.

7. The apparatus of claim 1, wherein the apparatus is provided with at least two destructurers, whereby one side surface of the pusher means is configured to push the item towards a first one of the destructurers and whereby the other side surface of the pusher means is configured to push the item towards a second one of the destructurers.

8. The apparatus according to claim 7, wherein said first destructurer and said second destructurer are located at a respective end region of a table.

9. A method for receiving and destructuring collectable items, comprising:

providing an item receiving floor, providing an item pusher for reciprocal slidable movement along the floor, causing an item when placed on the floor to be engaged by a surface of the pusher and pushed towards and into engagement with a destructurer, providing drive means for said item pusher to provide gradually increasing pushing force on the item along the floor towards a destructurer, providing said pusher drive means with a drive motor and a pushing force mechanism, providing the pushing force mechanism with first, second and third link member pairs, and providing a link registering means, enabling each of said first link members at one end thereof to be pivotally operative with a drive shaft of the motor, and pivotally connecting the other end to one end of an associated one of the second link members, enabling each of said second link members at the other end thereof to be pivotally linked to and associated with one of the third link members at a location between the ends thereof, and at a location between its ends pivotally attaching said second link members to a housing of the destructurer, and enabling each of said third link members at one end to be pivotally attached to the pusher, and making its other end fork shaped for successive engagement with registering pins forming said link registering means upon movement of the pusher from one end position to another end position along the floor.

10. The method of claim 9, wherein said destructuring is made through use of one of: item compacting, item flattening, item shredding, item chipping, item flaking, and item granulation.

11. The method of claim 9, wherein said destructuring is performable on items in the form of empty beverage containers.

* * * * *